US009689246B2

(12) United States Patent
Braithwaite et al.

(10) Patent No.: US 9,689,246 B2
(45) Date of Patent: Jun. 27, 2017

(54) STIMULATION DEVICES, INITIATION SYSTEMS FOR STIMULATION DEVICES AND RELATED METHODS

(71) Applicant: Orbital ATK, Inc., Dulles, VA (US)

(72) Inventors: Paul C. Braithwaite, Brigham City, UT (US); Michael E. Adams, Brigham City, UT (US)

(73) Assignee: Orbital ATK, Inc., Plymouth, MN (US)

( * ) Notice: Subject to any disclaimer, the term of this patent is extended or adjusted under 35 U.S.C. 154(b) by 395 days.

(21) Appl. No.: 14/227,988

(22) Filed: Mar. 27, 2014

(65) Prior Publication Data

US 2015/0275642 A1 Oct. 1, 2015

(51) Int. Cl.
*E21B 43/263* (2006.01)
*E21B 43/11* (2006.01)
*E21B 43/117* (2006.01)

(52) U.S. Cl.
CPC ..... *E21B 43/263* (2013.01); *E21B 43/11* (2013.01); *E21B 43/117* (2013.01)

(58) Field of Classification Search
CPC ..... E21B 43/263; E21B 29/02; E21B 43/117; E21B 43/11; E21B 43/116; E21B 43/1185; F42B 3/00; F42D 1/02
See application file for complete search history.

(56) References Cited

U.S. PATENT DOCUMENTS 2,023,784 A 12/1935 Farren et al.
2,959,001 A 11/1960 Porter
3,313,234 A 4/1967 Mohaupt
3,422,760 A 1/1969 Mohaupt
3,713,359 A 1/1973 Andrew
3,721,297 A * 3/1973 Challacombe ..... E21B 43/263 166/299
3,730,049 A 5/1973 Andrew
3,771,451 A 11/1973 Woodring
(Continued)

FOREIGN PATENT DOCUMENTS

GB 2 432 381 A 5/2007
WO 2009038843 A2 3/2009
(Continued)

OTHER PUBLICATIONS

International Search Report, ISA/EP, for International Patent Application No. PCT/US2015/021802, mailed Sep. 15, 2015, five (5) pages.
(Continued)

*Primary Examiner* — Kipp Wallace
(74) *Attorney, Agent, or Firm* — TraskBritt

(57) ABSTRACT

Downhole stimulation devices include an energetic material disposed within a housing and an initiator for igniting the energetic material. The initiator may comprise a shaped charge configured to produce a projectile to penetrate the energetic material to ignite the energetic material. The housing of the device may comprise a continuous outer surface. Methods of operating a downhole stimulation device include initiating an energetic material disposed within a housing of the stimulation device in order to burn the energetic material in a laterally extending direction transverse to a depth of a borehole in which the stimulation device is disposed.

27 Claims, 7 Drawing Sheets

(56) References Cited

U.S. PATENT DOCUMENTS 4,039,030 A 8/1977 Godfrey et al.
4,064,935 A * 12/1977 Mohaupt ..... E21B 43/263 102/313
4,290,486 A * 9/1981 Regalbuto ..... E21B 29/02 102/312
4,329,925 A * 5/1982 Hane ..... F42D 1/04 102/310
4,391,337 A 7/1983 Ford et al.
4,522,448 A 6/1985 Nitzberg
4,530,396 A * 7/1985 Mohaupt ..... E21B 29/02 102/313
4,537,255 A 8/1985 Regalbuto et al.
4,633,951 A 1/1987 Hill et al.
4,683,943 A 8/1987 Hill et al.
4,756,250 A 7/1988 Dias dos Santos
4,798,244 A 1/1989 Trost
4,823,875 A 4/1989 Hill
4,823,876 A 4/1989 Mohaupt
4,850,438 A 7/1989 Regalbuto
4,976,318 A 12/1990 Mohaupt
5,083,615 A * 1/1992 McLaughlin ..... E21B 43/263 149/87
5,295,545 A 3/1994 Passamaneck
5,325,783 A 7/1994 Wong
5,348,597 A 9/1994 Wong
5,355,802 A 10/1994 Petitjean
5,385,098 A 1/1995 Lindqvist et al.
5,388,518 A 2/1995 Wong
5,404,813 A 4/1995 Wong
5,551,520 A 9/1996 Bethel et al.
5,598,891 A 2/1997 Snider et al.
5,775,426 A 7/1998 Snider et al.
5,894,888 A 4/1999 Wiemers et al.
5,930,730 A 7/1999 Marfurt et al.
6,082,450 A 7/2000 Snider et al.
6,138,753 A 10/2000 Mohaupt
6,158,511 A 12/2000 Wesson
6,263,283 B1 7/2001 Snider et al.
6,308,607 B1 10/2001 Woodall et al.
6,336,506 B2 1/2002 Wesson
6,378,611 B1 4/2002 Helderle
6,494,261 B1 12/2002 Pahmiyer
6,497,285 B2 12/2002 Walker
6,561,274 B1 5/2003 Hayes et al.
6,755,249 B2 6/2004 Robison et al.
6,817,298 B1 * 11/2004 Zharkov ..... E21B 43/006 102/288
6,865,792 B2 3/2005 Kash
6,865,978 B2 3/2005 Kash
6,926,096 B2 8/2005 Kash
7,228,906 B2 6/2007 Snider et al.
7,377,204 B2 5/2008 Simmons
7,565,930 B2 * 7/2009 Seekford ..... E21B 43/263 102/317
7,707,939 B2 5/2010 Brent et al.
7,810,569 B2 10/2010 Hill et al.
7,891,297 B1 2/2011 Rohr
7,946,207 B1 5/2011 Porter et al.
7,950,457 B2 5/2011 Seekford
8,033,333 B2 10/2011 Frazier et al.
8,186,425 B2 5/2012 Smart et al.
8,186,435 B2 5/2012 Seekford
8,381,627 B2 2/2013 Fannon et al.
2005/0109509 A1 5/2005 Snider et al.
2006/0048664 A1 3/2006 Tiernan et al.
2006/0075890 A1 4/2006 Tiernan
2008/0073081 A1 * 3/2008 Frazier ..... E21B 43/11 166/280.1
2008/0245254 A1 10/2008 Brent et al.
2010/0162911 A1 7/2010 Andrzejak
2011/0114726 A1 5/2011 Porter et al.
2013/0014663 A1 1/2013 Lumley
2013/0092378 A1 4/2013 Mhaskar et al.
2013/0168077 A1 7/2013 Jackson et al.
2014/0060839 A1 3/2014 Wang et al.
2014/0238678 A1 8/2014 Arrell et al.

FOREIGN PATENT DOCUMENTS

WO 2009038843 A3 3/2009
WO 2013106850 A1 7/2013
WO 2013147980 A1 10/2013
WO 2013151603 A1 10/2013
WO 2013151604 A1 10/2013
WO 2013154628 A1 10/2013

OTHER PUBLICATIONS

Written Opinion, ISA/EP, for International Patent Application No. PCT/US2015/021802, mailed Sep. 15, 2015, Seven (7) pages.
Fong, Richard, "Warhead Technology Advancements," NDIA Armaments for the Army Transformation Conference, Jun. 19-21, 2000, 27 pages, Arlington, Virginia, US.
Sherman, Maurina S., "The Right Bang for the Job," Lawrence Livermore National Laboratory, S&TR Nov. 2004, pp. 20-22, Livermore, California, US.
Thakre, Piyush et al., "Solid Propellants," Encyclopedia of Aerospace Engineering, 2010 John Wiley & Sons, Ltd., pp. 1-10, Atlanta, Georgia, US.

* cited by examiner

STIMULATION DEVICES, INITIATION SYSTEMS FOR STIMULATION DEVICES AND RELATED METHODS

TECHNICAL FIELD

Embodiments of the present disclosure relate to stimulation devices for initiating energetic material in downhole applications. More particularly, embodiments of the present disclosure relate to stimulation devices including a housing having an energetic material disposed therein and an initiation system for igniting the energetic material in order to stimulate formations intersected by a wellbore and related methods.

BACKGROUND

Downhole stimulation techniques include high energy-based downhole stimulation techniques and propellant-based downhole stimulation techniques. Such downhole stimulation techniques generally are implemented to increase the effective surface area of producing formation material available for production of hydrocarbons resident in the formation by opening and enlarging cracks in the rock of the formation.

High energy-based downhole stimulation techniques generally employ the detonation of high energy explosive material within a wellbore. The resultant shockwave caused by detonation of the high energy explosive material in the wellbore may be employed to fracture a formation adjacent the wellbore.

Propellant-based downhole stimulation techniques generally employ tools having a circular cylinder housing filled with propellant grain, which may comprise a single volume or a plurality of propellant "sticks" in a housing. Such tools may include conventional propellant ignition systems that use pyrotechnic initiators or small rocket motors. When deployed in a wellbore adjacent a producing formation, the ignition systems will generally initiate a burn at one end of the propellant grain (i.e., a cigarette-type burn) that must propagate along the entire length of the propellant grain. As the propellant grain is initiated, gases from the burning propellant grain exit the housing through holes formed in the housing, entering the producing formation. The pressurized gas may be employed to fracture a formation, to perforate a formation when spatially directed through apertures in the housing against the wellbore wall, or to clean existing fractures or perforations in a formation made by other techniques.

Alternatively, the housing of the tool may include an axially extending bore through the center of the propellant grain and a detonation cord extending through the bore. When deployed in a wellbore adjacent a producing formation, the detonation cord will initiate a burn along the axially extending bore through the center of the propellant grain that will propagate generally radially through the ignited propellant grain. As the propellant grain is initiated, gases from the burning propellant grain exit the housing through preformed holes (which may be initially closed by a thinner housing wall, by a so-called "burst disk," or by another covering structure to prevent propellant contamination by wellbore fluid) formed in the housing, entering the producing formation. The pressurized gas may be employed to fracture a formation, to perforate a formation when spatially directed through apertures in the housing against the wellbore wall, or to clean existing fractures or perforations in a formation made by other techniques.

U.S. Pat. No. 8,033,333 to Frazier et al., the disclosure of which is incorporated herein in its entirety by this reference, discloses such a propellant-based downhole stimulation device including a detonation cord. The downhole stimulation device includes a housing holding a propellant therein. A detonation cord is disposed in an axially extending bore through the center of the propellant. Initiation of the detonation cord ignites the propellant. Openings or holes in the housing, which are generally initially sealed, serve as passageways for the expelled gas from the ignited propellant to exit the housing into the wellbore.

However, conventional propellant ignition systems that use pyrotechnic initiators or small rocket motors generally provide initiation of the propellant housed therein over a period of ten to one hundred milliseconds. Such a relatively long ignition period as compared to a much shorter period of ignition of high explosive materials may not be desirable in some applications. Such a relatively long ignition period renders impractical and ineffective any contemplated use of the two types of stimulation devices in combination as the ignition of the propellant grain would start well after the detonation of the explosive materials. Thus, formation fractures opened by detonation of an explosive in the wellbore might partially or completely collapse before gas could emanate from a propellant-based stimulation tool to desirably extend and enlarge the fractures. Further, the relatively slower burn of the propellant grain traveling from one end of the propellant grain to the other opposing end also requires relatively more time to build the desired pressures in the housing of the tool. Such a relatively longer time domain to build pressure within the housing may also render impractical and ineffective any contemplated use of propellant-based and explosive-based stimulation devices in combination as the gases produced by combustion of the propellant grain would start exiting the housing well after the detonation of the explosive materials, again negating any potential benefit of deploying propellant-based stimulation tools in the same wellbore as explosive-based stimulation tools. Further, gases produced by combustion of the propellant grain in a conventional propellant-based stimulation tool employing preformed holes in the tool housing to exit gas generated within the tool will exit the tool at a relatively low pressure, reducing the potential benefit of fracture expansion.

Other conventional downhole stimulation devices including initiation systems including a detonation cord, such as those disclosed in U.S. Pat. No. 8,033,333, may not produce the desired pressures in the tool within the desired time domain when implemented in systems including both propellant-based and explosive-based stimulation. Further, the preformed openings in the housing may not allow the desired pressures to build in the housing of the tool as gases will start exiting the housing through the openings once the initial seals are breached. Further still, the initiation of the propellant grain along the bore formed in the propellant grain requires a reduction in overall propellant grain in the housing in order to form the bore, thereby, restricting the amount of propellant that is available in the housing to combust. Finally, the initiation of the propellant grain along the bore formed in the propellant grain may also require relatively more time to build the desired pressures in the housing of the tool as the bore within the propellant grain forms a void in the propellant grain that must be pressurized along with the remainder of the housing.

BRIEF SUMMARY

In some embodiments, the present disclosure comprises a downhole stimulation device including a housing having a first end, a second end, and a longitudinal axis extending between the first end and the second end, an energetic material disposed within the housing, and an initiator coupled to the housing at one of the first end and the second end. The initiator comprises a shaped charge for igniting the energetic material within the housing. The shaped charge is configured to produce a projectile to penetrate the energetic material in order to ignite the energetic material.

In some embodiments, the shaped charge is configured to produce the projectile to penetrate the energetic material along a majority of the housing from the first end to the second end of the housing.

In some embodiments, the energetic material entirely fills a cross-sectional area within the housing taken in a direction transverse to the longitudinal axis proximate to the initiator.

In other embodiments, the present disclosure comprises a downhole stimulation device including a cylindrical housing having a first end, a second end, and a longitudinal axis extending between the first end and the second end. A lateral outer surface of the cylindrical housing extending a direction transverse to the longitudinal axis of the housing comprises a continuous surface. The downhole stimulation device further includes an energetic material disposed within the cylindrical housing and an initiator coupled to the cylindrical housing at one of the first end and the second end. The initiator comprises a shaped charge for igniting the energetic material within the cylindrical housing.

In some embodiments, the energetic material entirely fills at least a majority of an inner portion of the cylindrical housing coincident with and surrounding a centerline of the cylindrical housing.

In further embodiments, the present disclosure comprises a downhole stimulation device including a cylindrical housing having a first end, a second end, a longitudinal axis extending between the first end and the second end, and an imperforate lateral outer surface. The downhole stimulation device further includes an energetic material disposed within the cylindrical housing and an initiator coupled to the cylindrical housing at one of the first end and the second end. The imperforate lateral outer surface of the housing is adapted to deform under internal pressure in the housing caused by gases produced by combustion of the energetic material in the cylindrical housing to form at least one aperture in the cylindrical housing to permit expulsion from the cylindrical housing of the gases produced by the combustion of the energetic material.

In yet other embodiments, the present disclosure comprises a method of operating a downhole stimulation device. The method includes disposing a stimulation device having an energetic material disposed within a housing of the stimulation device in a borehole, initiating the energetic material with a jet formed with a shaped charge by penetrating the energetic material with the jet to ignite the energetic material along a depth of the borehole, and burning the energetic material in a laterally extending direction transverse to the depth of the borehole.

In yet other embodiments, the present disclosure comprises a method of operating a downhole stimulation device. The method includes initiating an energetic material disposed within a housing of the stimulation device, burning the energetic material in a laterally extending direction transverse to a depth of a borehole in which the stimulation device is disposed, forming at least one aperture in the housing with internal pressure in the housing caused by gases produced by combustion of the energetic material, and producing at least one gas steam extending laterally from the housing formed by the gases produced by combustion of the energetic material.

DETAILED DESCRIPTION

The illustrations presented herein are not actual views of any particular stimulation device or component thereof, but are merely idealized, schematic representations that are employed to describe embodiments of the present disclosure.

In some embodiments, the present disclosure comprises a stimulation device including a housing filled with an energetic material (e.g., a propellant). The stimulation device further includes an initiation device comprising, for example, a shaped charge coupled to the housing of the stimulation device. The initiation device is configured to produce a jet of sufficiency high kinetic energy to travel through the energetic material in the housing longitudinally and ignite the energetic material to burn laterally outwardly. Ignition and burn of the energetic material generates high pressure combustion gases that exit the housing in order to stimulate one or more subterranean formations proximate the stimulation device in a subterranean wellbore.

In some embodiments, the energetic material may at least substantially fill the housing. For example, the energetic material may entirely fill the housing or may fill a majority of the length of the housing with the exception of one or more voids in the energetic material positioned at one or more axial ends of the of the housing.

In one embodiment, the energetic material may fill the portion of the housing proximate (e.g., coincident with and surrounding) a centerline of the housing.

In some embodiments, the lateral sides of the housing may be substantially continuous. For example, the housing may be formed to have a continuous lateral outer surface without any openings formed in the lateral outer surface.

Figure 1:
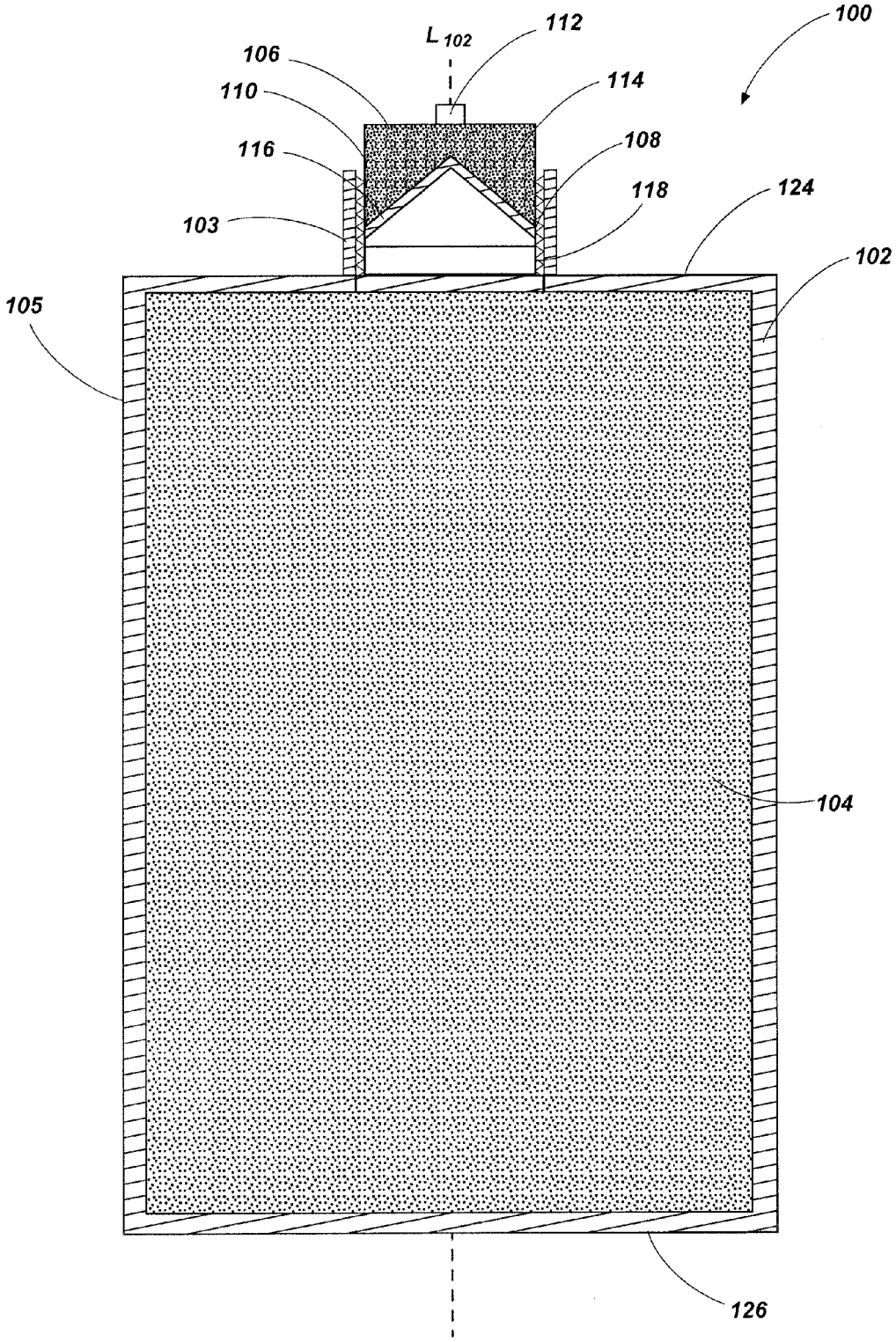
FIG. 1 is a schematic partial cross-sectional side view of a stimulation device in accordance with an embodiment of the present disclosure.

Referring to FIG. 1, a schematic cross-sectional view of a stimulation device 100 for use in stimulating a producing formation in a wellbore is shown. As used herein, "producing formation" means and includes, without limitation, any target subterranean formation having the potential for producing hydrocarbons in the form of oil, natural gas, or both, as well as any subterranean formation suitable for use in geothermal heating, cooling, and power generation.

Stimulation device 100 may be deployed in a wellbore adjacent a producing formation by conventional techniques including, without limitation, wireline, tubing and coiled tubing. In some embodiments, formation stimulation may take the form of one or more of fracturing a target, pristine rock formation and restimulation of an existing producing well.

Stimulation device 100 comprises a housing 102. In some embodiments, the housing 102 may comprise a substantially cylindrical shape (e.g., having a cylindrical cross section). In some embodiments, the housing 102 may be formed from a material such as, for example, a metal (e.g., steel), a metal alloy (e.g., aluminum), a composite, or combinations thereof.

As depicted, the lateral side or sides of the housing 102 may be substantially continuous. For example, the housing 102 may have a continuous (e.g., uniform, monolithic) lateral portion 105 (e.g., a lateral outer surface extending in a direction transverse to (e.g., perpendicular to) and along a longitudinal axis $L_{102}$ (e.g., centerline) of the housing 102) without any openings formed in the lateral portion 103. In embodiments where the housing 102 has a substantially cylindrical shape, the housing 102 may substantially consist of a barrel forming the lateral portion 103 and two end caps (e.g., first end 124 and second end 126) on either side of the barrel where the barrel has a continuous outer surface without any laterally extending openings formed therein.

An energetic material 104 (e.g., propellant grain) is disposed in the housing 102. The energetic material 104 may fill a majority of the housing 102. For example, the energetic material 104 substantially fills (e.g., entirely fills) one or more cross-sectional areas within the housing 102 taken in a direction transverse to (e.g., perpendicular to) and along the longitudinal axis $L_{102}$ (e.g., centerline) of the housing 102. In such an embodiment, the one or more cross-sectional areas may be taken proximate (e.g., adjacent) an initiator element, discussed below. In some embodiments, the energetic material 104 may entirely fill the housing 102. In other embodiments, the energetic material 104 may fill a majority of the axial length of the housing 102 with the exception of one or more voids in the energetic material 104 positioned at one or more axial ends (e.g., first end 124 and second end 126) of the of the housing 102. In some embodiments, the energetic material 102 may fill the portion of the housing 102 proximate (e.g., coincident with and surrounding) the longitudinal axis $L_{102}$ (e.g., centerline) of the housing 102.

In some embodiments, the energetic material 104 may be surrounded (e.g., laterally surrounded) by the housing 102 (e.g., the lateral portion 103 of the housing 102).

An initiator element (e.g., shaped charge 106) may be positioned proximate to the housing 102. For example, the shaped charge 106 may be coupled to (e.g., removably coupled) the housing 102 via a connection between the shaped charge 106 and a portion of the housing 102 (e.g., raised portion 103), such as, for example, threaded connection 108. In other embodiments, the connection between the shaped charge 106 and the housing 102 may comprise other suitable connections (e.g., a connection utilizing fasteners, an interference fit, quick connect/disconnect fittings, etc.). In some embodiments, as discussed below with regard to FIG. 4, at least a portion of the shaped charge 106 may be disposed within the housing 102 (e.g., within a cavity formed in the energetic material 104). In some embodiments, the connection 108 may form a seal between the shaped charge 106 and the housing 102.

The shaped charge 106 may include a case 110, an initiator 112, an explosive material 114, and one or more liners (e.g., a liner 116). In some embodiments, the liner 116 may comprises one or more materials, such as, for example, a metal (e.g., copper), a consolidated powdered metal (e.g., powdered copper, powdered copper and tungsten), a metal alloy (e.g., aluminum), a ceramic, a reactive material (e.g., aluminum/PTFE, nickel/aluminum, zirconium/epoxy, iron oxide/potassium perchlorate/fluropolymer), or combinations thereof.

In some embodiments, the configurations, shapes, and sizes of one or more of the case 110, explosive material 114, and liner 116 may be tailored to produce a desired projectile (e.g., the shape, width, speed, penetration depth, or combinations thereof of the projectile) for a specific application. For example, the case 110 may be formed in a shape such as a generally cylindrical tube or other suitable shapes in order to produce the desired shape of a projectile formed from the liner 116.

At least a portion of the case 110 may be filled with the explosive material 114. The explosive material 114 may be formed within the interior of the case 110 and may comprise an explosive material 114 such as polymer-bonded explosives ("PBX"), LX-14, C-4, OCTOL, trinitrotoluene ("TNT"); cyclo-1,3,5-trimethylene-2,4,6 trinitramine ("RDX"); cyclotetramethylene tetranitramine ("HMX"); hexanitrohexaazaisowurtzitane ("CL 20"); waxed RDX, HMX and/or CL-20; combinations thereof; or any other suitable explosive material. In some embodiments, the explosive material 114 may also be formed to have a countersunk recess in a forward surface of the explosive material 114 to receive the placement of a liner or liners 116.

The case 110 may also include a detonator such as the initiator 112 located, for example, at the rear surface of the case 110. The initiator 112 may comprise any known detonation device sufficient to detonate the explosive material 114 within the case 110 including, but not limited to, explosives such as pentaerythritol tetranitrate ("PETN"), PBXN-5, CH-6, blasting caps, and electronic detonators (e.g., exploding-bridgewire detonators (EBW), exploding foil initiators).

When the explosive material 114 in the shaped charge 106 is detonated by the initiator 112, the liner 116 is formed into a projectile (see, e.g., projectile 120 (FIG. 2)) that has a high kinetic energy capable of penetrating solid objects, such as the energetic material 104 within the housing 102 of the stimulation device 100. A high-pressure detonation shockwave is generated by the rapidly combusting explosive material 114. The high-pressure explosive gases behind the detonation shockwave impart energy and projectile formation forces to the liner 116. The shockwave created by detonation of the explosive material 114 may propagate radially or linearly through the shaped charge 106 from the initiator 112 toward the open end of the case 110. The case 110 will tend to direct the pressure volume energy generated by ignition of the explosive material 114 through the open end of the case 110, thereby, imparting a substantial amount of the pressure volume energy produced by this ignition to the liner 116. The pressure volume energy delivered to the liner 116 simultaneously deforms the liner 116 into a projectile and propels the forming or formed projectile at a velocity from the case 110.

In some embodiments, the shaped charge 106 may be set at a selected standoff distance from the energetic material 104 within the housing 102 of the stimulation device 100. For example, the housing 102 of the stimulation device 100 may include a standoff structure 118 (e.g., a tube) positioned between the shaped charge 106 and the housing 102 to provide a selected distance (e.g., 0.5 inch (12.7 millimeters) to 2.0 inches (50.8 millimeters)) between the shaped charge 106 and the energetic material 104 within the housing 102.

Figure 2:
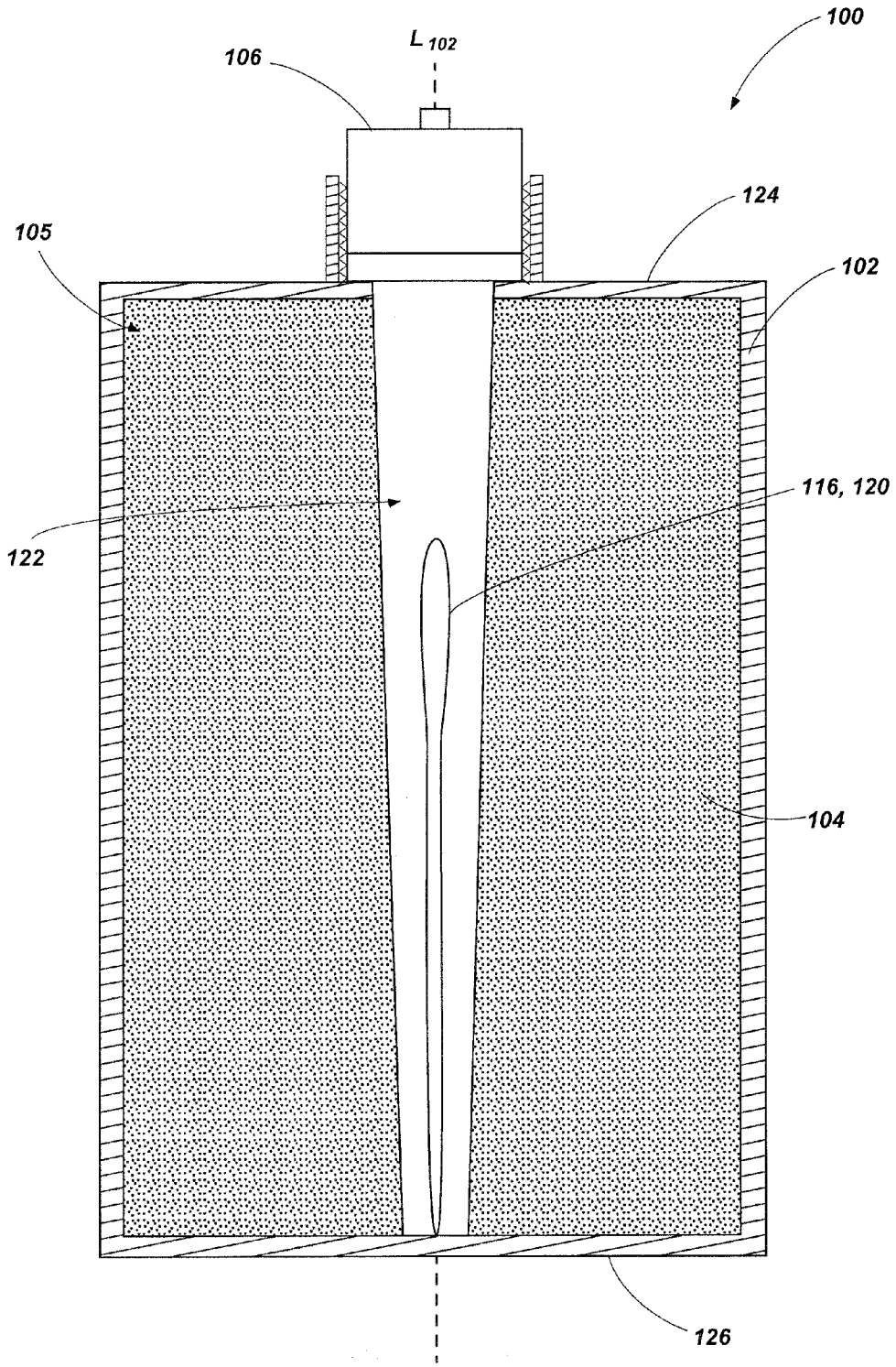
FIG. 2 is a schematic partial cross-sectional side view of the stimulation device of FIG. 1 shown during initiation of an energetic material within the stimulation device.

FIG. 2 is a schematic cross-sectional view of the stimulation device 100 shown during initiation of the energetic material 104 within the housing 102 of the stimulation device 100. As shown in FIG. 2, in use and when stimulation device 100 is deployed in a wellbore adjacent a producing formation, the shaped charge 106 is triggered (e.g., by a firing unit) causing the liner 116 be explosively expelled from the case 110 as discussed above. The liner 116 (now formed into a projectile 120 or jet) may travel through the energetic material 104 within the housing 102 of the stimulation device 100. The projectile 120 may travel through (e.g., penetrate) the energetic material 104. For example, the projectile 120 may form a channel 122 through the energetic material 104 (e.g., a separation in the energetic material 104).

The projectile 120 may travel (e.g., displace) through the energetic material 104 from a first end 124 of the housing 102 (e.g., a first axial end) toward (e.g., to or beyond) a second end 126 (e.g., a second axial end) of the housing 102 opposing the first end 124. In some embodiments, the projectile 120 may travel through the energetic material 104 along the longitudinal axis $L_{102}$ (e.g., centerline) of the housing 102. It is noted that while the first and second ends 124, 126 of the housing 102 are shown as being substantially planar in FIGS. 1 and 2, in other embodiments, the first and second ends 124, 126 may have other shapes, such as, for example, a hemispherical shape.

In some embodiments, projectile 120 may penetrate a majority of the length (e.g., the entire length) of the energetic material 104 along the longitudinal axis $L_{102}$ of the housing 102 (e.g., a length of three feet (91.44 centimeters) or greater). For example, the projectile 120 may penetrate through the energetic material 104 from the first end 124 of the housing 102 to the second end 126. In some embodiments, the projectile 120 may penetrate a majority of the length of the energetic material 104 along the longitudinal axis $L_{102}$ of the housing 102 (e.g., 80% or more, 90% or more, 95% or more, 100% of the length of the energetic material 104) without penetrating the housing 102 at the second end 126 (e.g., stopping short of the housing 102, contacting the housing 102 without forming an opening through the housing 102 to the exterior of the housing 102). Such an embodiment may enable the majority of the energetic material 104 to be ignited along the length of the energetic material 104 while keeping the housing 102 intact (e.g., sealed) at the second end 126. Further, such an embodiment may enable the use of other stimulation devices proximate (e.g., adjacent) the stimulation device 100 while reducing the probability that the shaped charge 102 will inadvertently penetrate the housing 102 and ignite an adjacent device in the tool string.

The projectile 120 may be in the form of a high velocity jet of hot particles (e.g., a high-energy jet of material of the liner 116). As the projectile 120 travels through the energetic material 104 the high velocity and hot particles of the projectile 120 transfer energy (e.g., via frictional heating) to the energetic material 104 as the projectile 120 penetrates the energetic material 104. The energy transferred to the energetic material 104 by the projectile 120 ignites the energetic material 104. In some embodiments, the pressure wave of the projectile 120 imparted to the energetic material 104 by initiation of the shaped charge 106 may also aid in ignition of the energetic material 104. For example, the high pressures created by ignition of the shaped charge 106 may fracture the energetic material 104 into multiple smaller pieces thereby increasing the surface area of burning energetic material 104, which may enhance gas generation rates.

As the projectile 120 travels through the energetic material 104, the projectile 120 at least partially initiates burn (e.g., deflagration) of the energetic material 104, generating combustion products in the form of high pressure gases. The projectile 120 enables a majority (e.g., an entirety) of the energetic material 104 along the length of the longitudinal axis $L_{102}$ of the housing 102 to be initiated (e.g., directly initiated with the projectile 120 formed by the shaped charge 106). For example, the projectile 120 may substantially simultaneously (e.g., in less than one hundred microseconds (e.g., ten to one hundred microseconds)) ignite a majority (e.g., an entirety) of the energetic material 104 along the length of the longitudinal axis $L_{102}$ of the housing 102. The initiated burn may then propagate laterally (e.g., radially, i.e., a substantially radial burn) through the volume of energetic material 104. For example, the propagation of the burn laterally through the volume of energetic material 104 may create a progressive burn where the reacting surface area of the burning energetic material 104 increases over time.

In other embodiments, the number and/or positioning of one or more initiator devices (e.g., shaped charges 106) and configuration of the housing 102 and energetic material 104 therein may be tailored for one or more types of burn. For example, various components of the stimulation device 100 may be selected to produce a progressive burn, neutral burn (where the reacting surface area of the energetic material 104 remains substantially constant over time), regressive burn (when the reacting surface area of the energetic material 104 decreases over time), or combinations thereof upon ignition.

Figure 3:
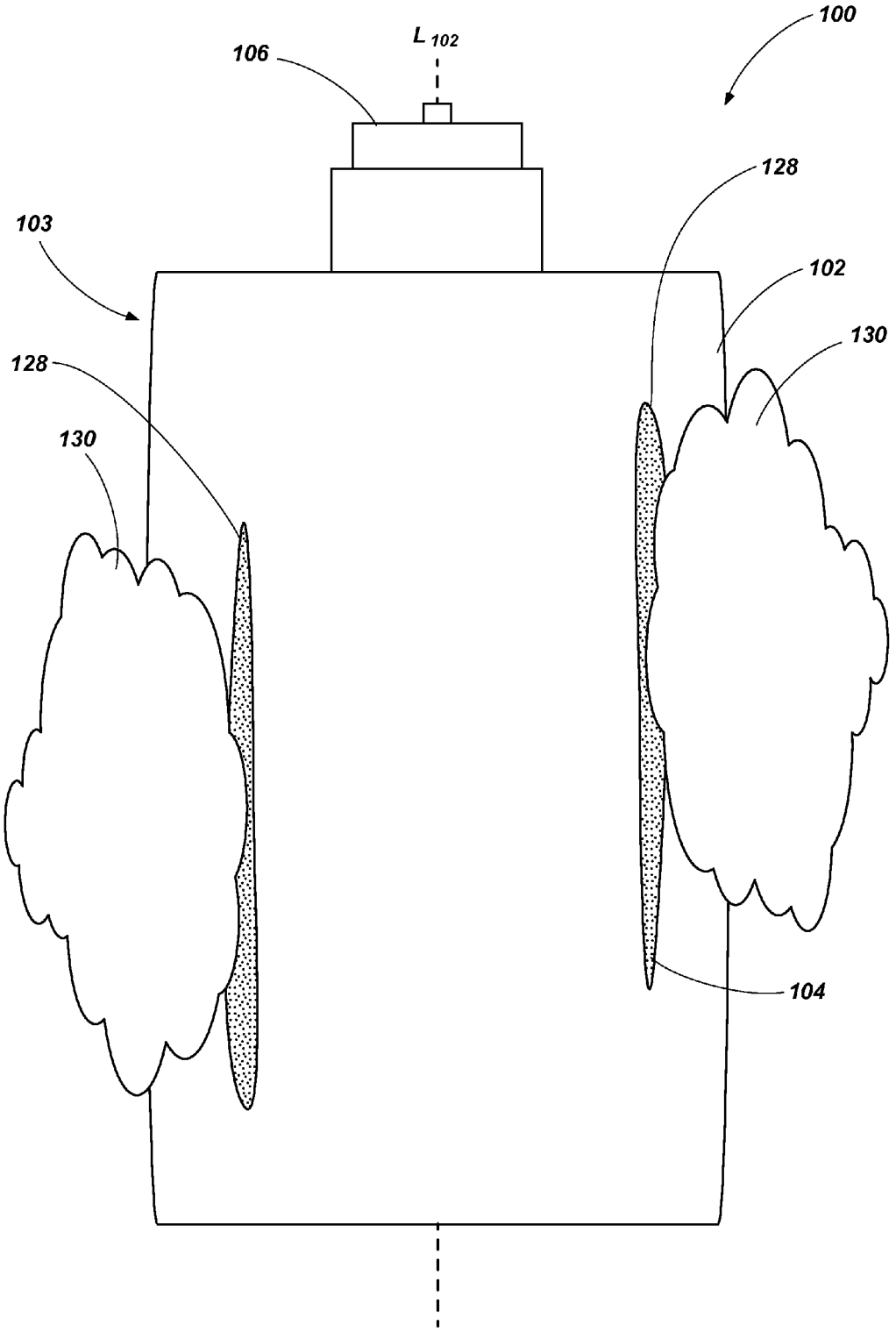
FIG. 3 is a schematic side view of the stimulation device of FIG. 1 shown during initiation of an energetic material within the stimulation device.

FIG. 3 is a schematic side view of the stimulation device 100 shown during further initiation of the energetic material 104 within the housing 102 of stimulation device 100. As shown in FIG. 3, the burn of the energetic material 104 within the housing 102 causes a buildup of pressure within the housing 102 (e.g., creating a pressure vessel). The buildup of pressure may act to deform the housing 102 of the stimulation device 100. For example, the pressure buildup may cause one or more portions of the housing 102 to deform (e.g., plastically deform) to create one or more openings in the housing 102 enabling the pressurized gas in the housing 102 to exit the housing 102. As depicted, the buildup of pressurized gas in the housing 102 may form one or more apertures 128 in the housing 102, which forms streams 130 of pressurized gas (e.g., jets of pressurized gas) as the gas passes through the housing 102. The gas streams 130 are employed to stimulate the subterranean formation adjacent to the stimulation device 100.

In some embodiments, the housing 102 may be configured such the buildup of pressure within the housing 102 causes at least some of the apertures 128 in the housing 102 to form in a direction along (e.g., substantially parallel to) the length or depth of the borehole in which the stimulation device 100 is to be deployed. For example, the housing 102 may be configured such that the buildup of pressure within the housing 102 causes at least some of the apertures 128 in the housing 102 to form in along the length (e.g., along the longitudinal axis $L_{102}$) of the housing 102. In embodiments where the stimulation device 100 has a cylindrical cross section, the housing 102 may be configured such that hoop stress in the cylindrical portion (e.g., the lateral portion 103) of the housing 102 forms the apertures 128 extending along the longitudinal axis $L_{102}$) of the housing 102. In some embodiments, the housing 102 may be tailored to provide one or more apertures 128 at substantially predetermined locations by, for example, varying the wall thickness of the housing 102.

The gas streams 130 may pass through the apertures 128 in the housing 102 in a direction transverse to (e.g., perpendicular to) one or more of the length or depth of the borehole and the length (e.g., along the longitudinal axis $L_{102}$) of the housing 102. In some embodiments, the stimulation device 100 may be configured to produce gas streams 130 around a substantial majority of the housing uniformly (e.g., 360° about the length of one or more of the borehole and of the housing 102), or directionally, such as, for example, in a 45° arc, a 90° arc, etc., transverse to (e.g., perpendicular to) one or more of the length or depth of the borehole and the length of the housing 102.

In embodiments of the present disclosure, propellant type, amount and burn rate may be adjusted to accommodate different geological conditions and provide different pressures and different pressure rise rates for maximum benefit. For example, the energetic material 104 may comprise ballistically-tailored propellant structures comprising two or more propellant grain that are formulated and configured to provide, for example, customizable burn types and rates, such as those disclosed in U.S. patent application Ser. No. 13/781,217 to Arrell Jr. et al., entitled "Method and Apparatus for Ballistic Tailoring of Propellant Structures and Operation Thereof for Downhole Stimulation," the disclosure of which is incorporated herein in its entirety by this reference.

One or more energetic materials (e.g., propellants) suitable for implementation of embodiments of the present disclosure may include, without limitation, a material used as a solid rocket motor propellant, such as, for example, a propellant comprising a powdered metal fuel. Various examples of such energetic material and components thereof are described in Thakre et al., *Solid Propellants*, Rocket Propulsion, Volume 2, Encyclopedia of Aerospace Engineering, John Wiley & Sons, Ltd. 2010, the disclosure of which document is incorporated herein in its entirety by reference. The energetic material may be a class 4.1, 1.4 or 1.3 material, as defined by the United States Department of Transportation shipping classification, so that transportation restrictions are minimized. By way of example, the energetic material may include a polymer having at least one of a fuel and an oxidizer incorporated therein. The polymer may be an energetic polymer or a non-energetic polymer, such as glycidyl nitrate (GLYN), nitratomethylmethyloxetane (NMMO), glycidyl azide (GAP), diethyleneglycol triethyleneglycol nitraminodiacetic acid terpolymer (9DT-NIDA), bis(azidomethyl)-oxetane (BAMO), azidomethylmethyl-oxetane (AMMO), nitraminomethyl methyloxetane (NAMMO), bis(difluoroaminomethyl)oxetane (BFMO), difluoroaminomethylmethyloxetane (DFMO), copolymers thereof, cellulose acetate, cellulose acetate butyrate (CAB), nitrocellulose, polyamide (nylon), polyester, polyethylene, polypropylene, polystyrene, polycarbonate, a polyacrylate, a wax, a hydroxyl-terminated polybutadiene (HTPB), a hydroxyl-terminated poly-ether (HTPE), carboxyl-terminated polybutadiene (CTPB) and carboxyl-terminated polyether (CTPE), diaminoazoxy furazan (DAAF), 2,6-bis (picrylamino)-3,5-dinitropyridine (PYX), a polybutadiene acrylonitrile/acrylic acid copolymer binder (PBAN), polyvinyl chloride (PVC), ethylmethacrylate, acrylonitrile-butadiene-styrene (ABS), a fluoropolymer, polyvinyl alcohol (PVA), or combinations thereof. The polymer may function as a binder, within which the at least one of the fuel and oxidizer is dispersed. In one embodiment, the polymer is polyvinyl chloride.

The fuel may be a metal (e.g., a consolidated powdered metal), such as aluminum, nickel, magnesium, silicon, boron, beryllium, zirconium, hafnium, zinc, tungsten, molybdenum, copper, or titanium, or alloys mixtures or compounds thereof, such as aluminum hydride ($AlH_3$), magnesium hydride ($MgH_2$), or borane compounds ($BH_3$). The metal may be used in powder form. In one embodiment, the metal is aluminum. The oxidizer may be an inorganic perchlorate, such as ammonium perchlorate or potassium perchlorate, or an inorganic nitrate, such as ammonium nitrate, sodium nitrate, or potassium nitrate. Other oxidizers may also be used, such as hydroxylammonium nitrate (HAN), ammonium dinitramide (ADN), hydrazinium nitroformate, a nitramine, such as cyclotetramethylene tetranitramine (HMX), cyclotrimethylene trinitramine (RDX), 2,4,6,8,10,12-hexanitro-2,4,6,8,10,12-hexaazaisowurtzitane (CL-20 or HNIW), and/or 4,10-dinitro-2,6,8,12-tetraoxa-4,10-diazatetracyclo-[$5.5.0.0^{5,9}.0^{3,11}$]-dodecane (TEX). In one embodiment, the oxidizer is ammonium perchlorate. The energetic material may include additional components, such as at least one of a plasticizer, a bonding agent, a burn rate modifier, a ballistic modifier, a cure catalyst, an antioxidant, and a pot life extender, depending on the desired properties of the energetic material. These additional components are well known in the rocket motor art and, therefore, are not described in detail herein. The components of the energetic material may be combined by conventional techniques, which are not described in detail herein.

Energetic material for implementation of embodiments of the present disclosure may be selected to exhibit, for example, burn rates from about 0.1 in/sec (2.54 millimeters/sec) to about 4.0 in/sec (101.6 millimeters/sec) at 1,000 psi (6894.8 kilopascals) and an ambient temperature of about 70° F. (21.1° C.). Burn rates will vary, as known to those of ordinary skill in the art, with variance from the above pressure and temperature conditions before and during the energetic material burn.

The energetic material may be cast, extruded or machined from an energetic material formulation. Casting, extrusion and machining of energetic material formulations are each well known in the art and, therefore, are not described in detail herein.

Figure 4:
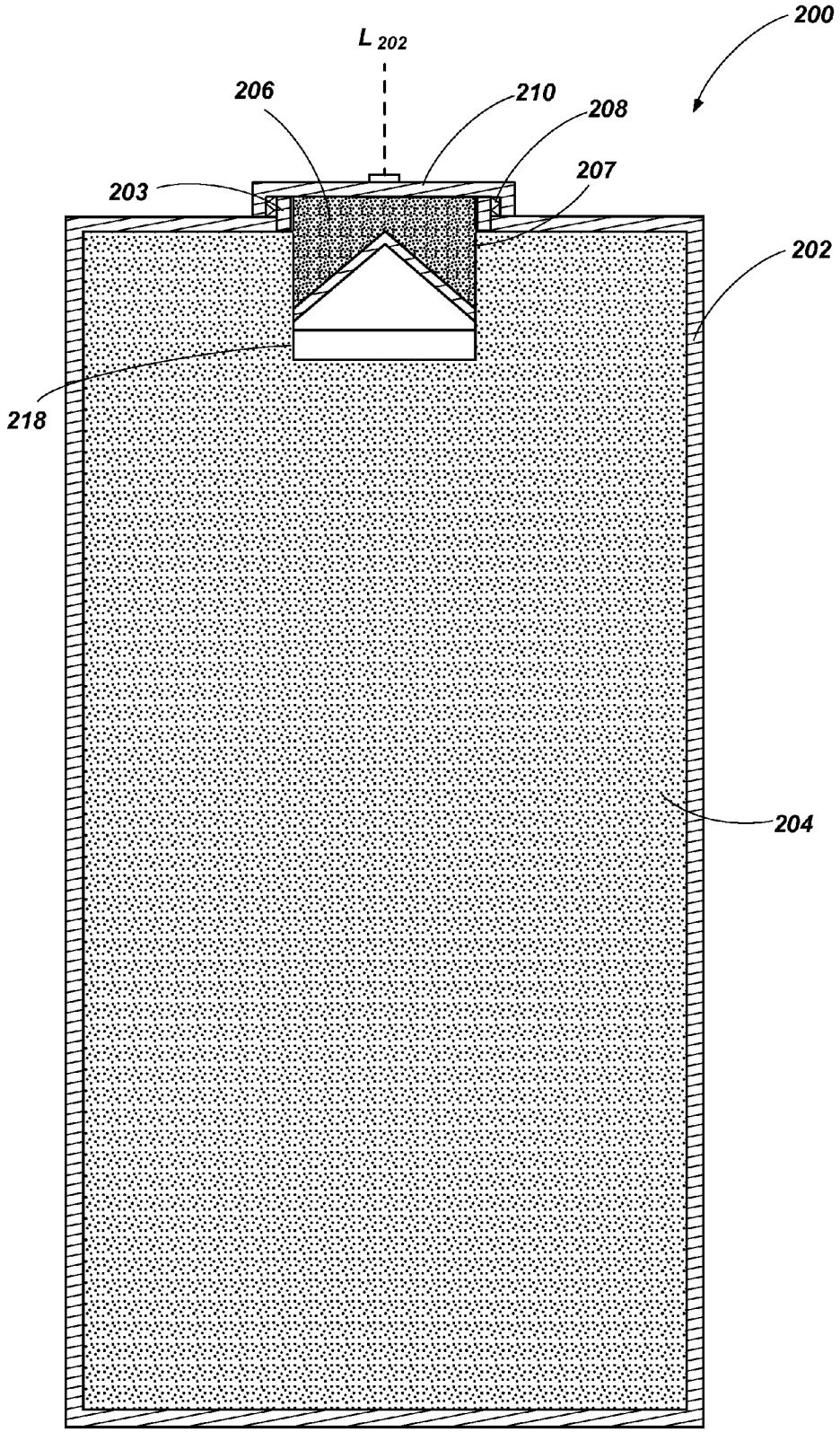
FIG. 4 is a schematic partial cross-sectional view of a stimulation device in accordance with an embodiment of the present disclosure.

FIG. 4 is a schematic cross-sectional view of a stimulation device 200 that may be similar to (e.g., one or more of similar components and operation) the stimulation device 100 discussed above in relation to FIGS. 1 through 3. As shown in FIG. 4, the stimulation device 200 includes a housing 202 having a longitudinal axis $L_{202}$ (e.g., centerline) with an energetic material 204 disposed in the housing 202. As depicted, an initiator element (e.g., shaped charge 206) may be at least partially positioned in a cavity 207 formed in the energetic material 204 within the housing 202. For example, the shaped charge 206 may be disposed at least partially within the cavity 207 and coupled to (e.g., removably coupled) the housing 202 (e.g., at a first axial end) via a connection 208 between the shaped charge 206 and the housing 202 (e.g., a threaded connection). In other embodiments, the connection 208 between the shaped charge 206 and the housing 202 may comprise other suitable connections (e.g., a connection utilizing fasteners, an interference fit, quick connect/disconnect fittings, etc.). In some embodiments, the connection 208 may form a seal between the shaped charge 206 and the housing 202.

In some embodiments, the cavity 207 (e.g., the centerline of the cavity 207) may be coextensive with the longitudinal axis $L_{202}$ (e.g., centerline) of the housing 202.

In some embodiments, the cavity 207 may only extend through a minor portion of the energetic material 204 in the housing 202 along the longitudinal axis $L_{202}$ of the housing 202.

In some embodiments, the shaped charge 206 may include a cap 210. The cap 210 may surround a portion of the housing 202 (e.g., raised lip 203) and the connection 208 between the shaped charge 206 and the housing 202 may be formed within the cap 210.

As above, in some embodiments, the shaped charge 206 may be set at a selected standoff from the energetic material 204 within the housing 202 of the stimulation device 200. For example, the housing 202 of the stimulation device 200 may include a standoff 218 (e.g., a tube) positioned between the shaped charge 206 and the housing 202 to provide a selected distance (e.g., 0.5 inch (12.7 millimeters) to 2.0 inches (50.8 millimeters)) between the shaped charge 206 and the energetic material 204 within the housing 202.

Figure 5:
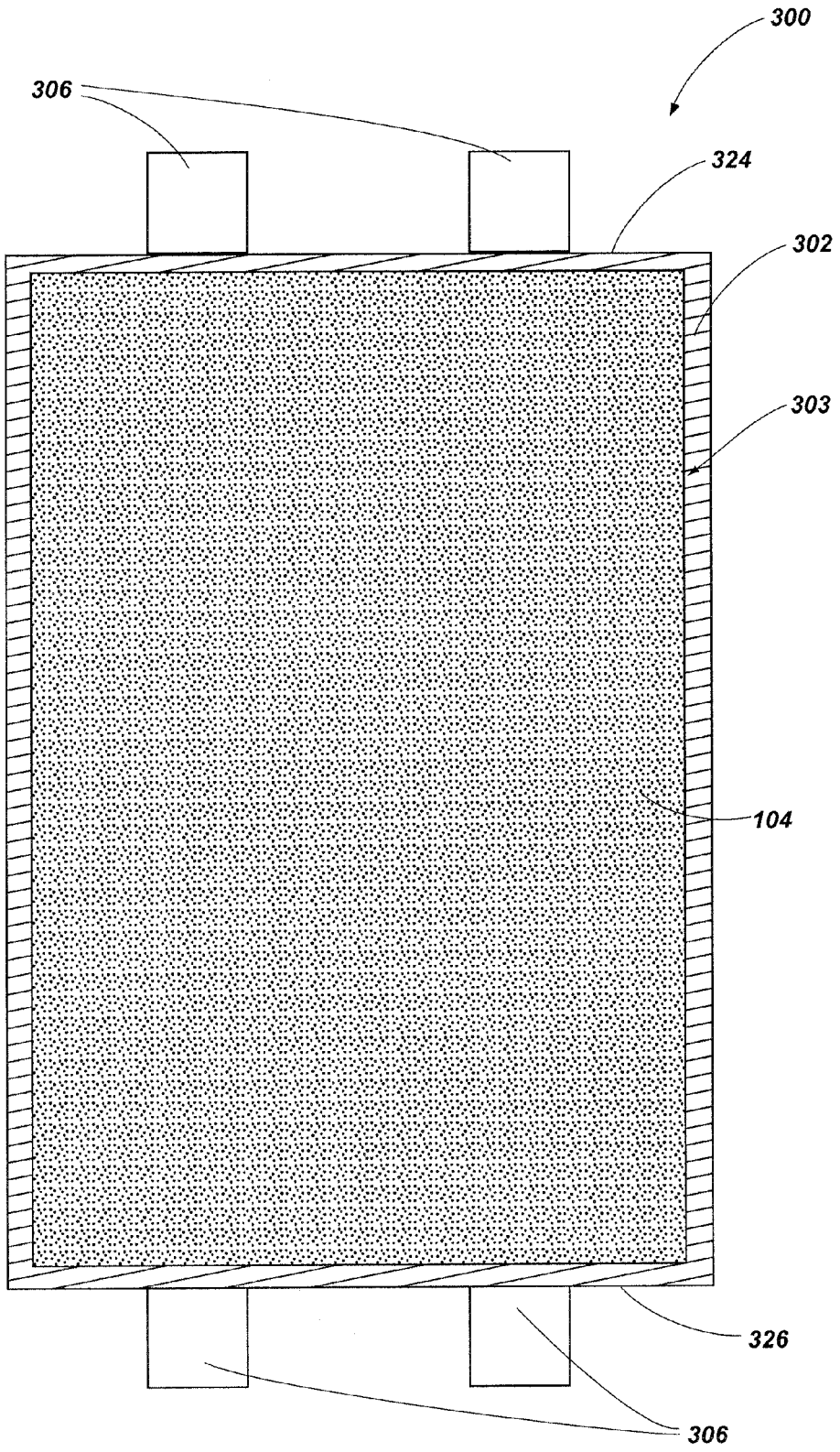
FIG. 5 is a schematic partial cross-sectional view of a stimulation device in accordance with an embodiment of the present disclosure.

FIG. 5 is a schematic cross-sectional view of a stimulation device 300 that may be similar to (e.g., one or more of similar components and operation) the stimulation devices 100, 200 discussed above in relation to FIGS. 1 through 4. As shown in FIG. 5, the stimulation device 300 includes a housing 302 having an energetic material 104 disposed in the housing 302. Multiple initiator elements (e.g., shaped charges 306) may be positioned proximate to the housing 302. For example, the shaped charges 306 may be coupled to (e.g., removably coupled) one or more of a first end 324 of the housing 302 (e.g., a first axial end), a second end 326 (e.g., a second axial end) of the housing 302, and a lateral portion 303 of the housing 302. As depicted, a plurality of shaped charges 306 may be coupled to the first end 324 of the housing 302 and the second end 326 (e.g., a second axial end) of the housing 302. Each of the shaped charges 306 may be triggered (e.g., by a firing unit) to form a projectile (e.g., projectile 120 (FIG. 2)) that travels through the energetic material 104 forming a channel (e.g., channel 122 (FIG. 2)) through the energetic material 104. Each projectile will at least partially initiate burn (e.g., a progressive burn) of a differing section of the energetic material 104, generating combustion products in the form of high pressure gases to stimulate a subterranean formation adjacent to stimulation device 100.

Figure 6:
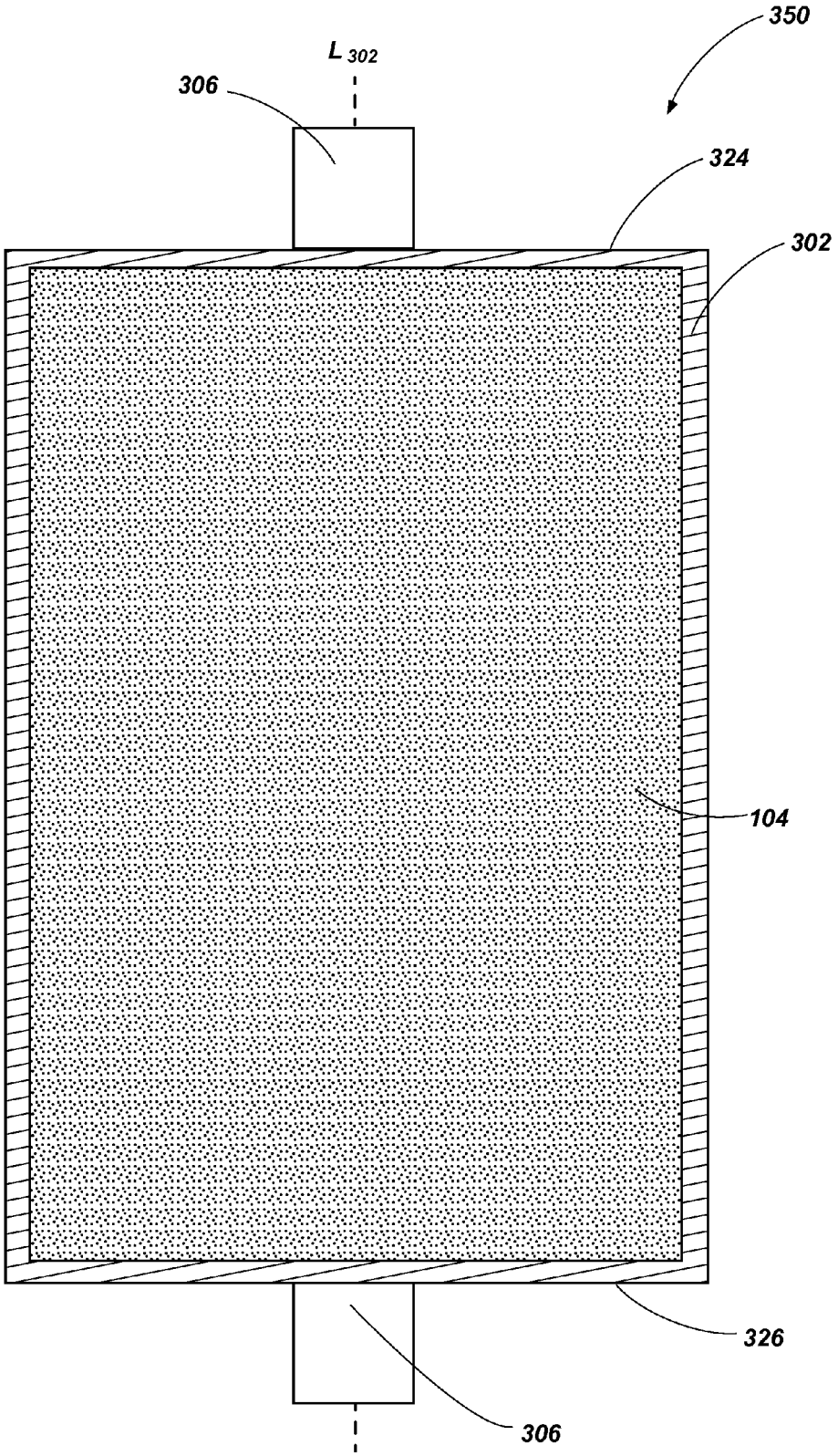
FIG. 6 is a schematic partial cross-sectional view of a stimulation device in accordance with an embodiment of the present disclosure.

FIG. 6 is a schematic partial cross-sectional view of a specific embodiment of a stimulation device 350 including multiple shaped charges 306. As depicted, the stimulation device 350 includes a first shaped charge 306 on the first end 324 of the housing 302 and another shaped charge 306 on the second end 326 of the housing 302. In some embodiments, the shaped charges 306 may be positioned along a longitudinal axis $L_{302}$ (e.g., centerline) of the housing 302 similar to that shown and described with reference to FIG. 1. The stimulation device 350 may enable projectiles from each shaped charge 306 to each ignite approximately half of the energetic material 104 along its length (e.g., where the projectiles meet at approximately the middle of the length of the housing 102).

Figure 7:
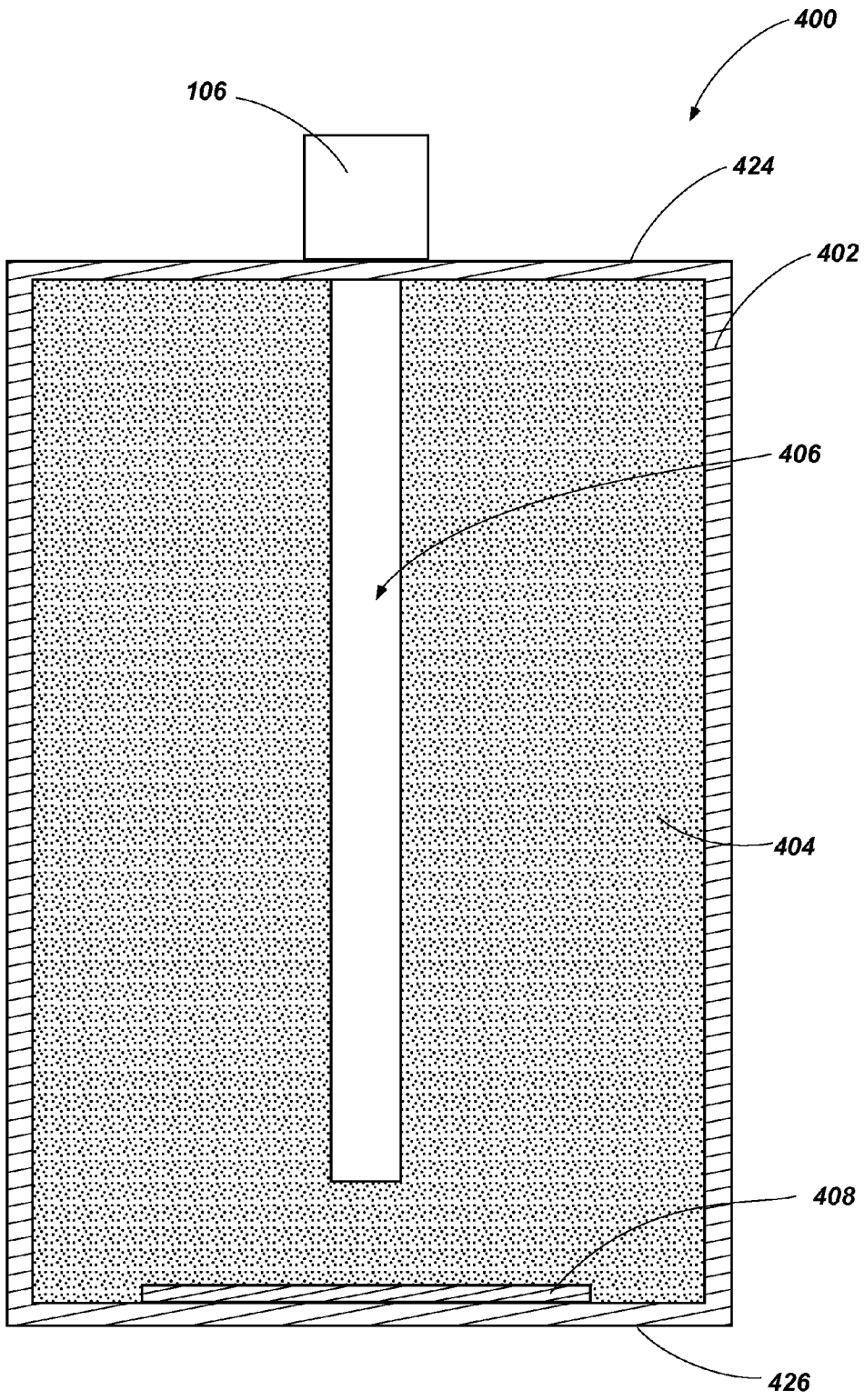
FIG. 7 is a schematic partial cross-sectional view of a stimulation device in accordance with an embodiment of the present disclosure.

FIG. 7 is a schematic cross-sectional view of a stimulation device 400 that may be similar to (e.g., one or more of similar components and operation) the stimulation devices 100, 200, 300, 350 discussed above in relation to FIGS. 1 through 6. As shown in FIG. 7, the stimulation device 400 includes a housing 402 having an energetic material 404 disposed in the housing 402. The energetic material 404 includes channel 406 initially formed in the energetic material 404. In some embodiments, the channel 406 may have a width that is less than the width of a portion of the shaped charge 106 (e.g., the width of the case 110 (FIG. 1), the width of the liner 116 (FIG. 1)). As depicted, the channel 406 may extend from a first end 424 toward a second end 426 of the housing 402. In some embodiments, the channel 406 may extend a length of housing 402 that is less than the entire length of the housing 402. In other embodiments, the channel 406 may extend the entire length of housing 402 from the first end 424 of the housing 402 to the second end 426 of the housing 402. In some embodiments, the channel 406 may be filled with a sacrificial material more easily penetrable by the shaped charge jet than the energetic material 404 for ease of manufacture of the channel 406 within energetic material 404. In some embodiments, the channel 406 may be filled with a different energetic material than energetic material 404, for example, an energetic material exhibiting a faster ignition and burn rate at lower pressures and temperatures than energetic material 404. In some embodiments, the stimulation device 400 may include a plate 408 at the second end 426 of the housing 402 to reduce the probability that the projectile formed by the shaped charge 106 will rupture the housing 402 in the axial direction. The stimulation device 400 may enable the projectile formed by the shaped charge 106 to travel a greater distance through the energetic material 404 as compared to a stimulation device without a channel while still enabling the projectile to ignite the energetic material 404 along its length. Further, in some embodiments, the stimulation device 400 may enable the use of a relatively lighter weight liner (e.g., aluminum) in the shaped charge 106 to form the projectile.

Embodiments of the present disclosure may provide stimulation devices that are more robust and effective than other similar stimulation devices. For example, stimulation devices in accordance with some embodiments of the present disclosure enable energetic material to fill the majority or entirety of the housing of the stimulation devices as opposed to stimulation devices that require a central bore formed through the energetic material to accommodate an initiator such as a detonation cord or small rocket igniter. Moreover, elimination of the central bore in some embodiments may reduce the cost and time required to manufacture the stimulation device. Embodiments of the disclosure thus enable deployment of a larger volume of energetic material in a stimulation tool of a given interior volume in comparison to conventional designs. For example, in some embodiments, the maximum amount of propellant capable of filing the housing may be used.

Further, a stimulation device employing an initiator device such as a shaped charge enables relatively faster and substantially simultaneous (i.e., within microseconds) ignition of the energetic material in the housing along a majority of or an entirety of the length of a stimulation tool as compared to conventional propellant initiators. Such a configuration enables a majority of the energetic material to be ignited along its length without rupturing and depressurizing the housing in the axial direction. Additionally, a stimulation device employing an initiator device such as a shaped charge may enable the production of a desired pressure within a desired time domain relatively faster than other conventional downhole stimulation devices employing an initiator such as a detonation cord.

For example, the stimulation device employing an initiator device such as a shaped charge may enable ignition of the energetic material in the housing in a similar time scale as the high explosives (e.g., approximately ten to one hundred microseconds) employed in conventional stimulation devices. Such a time scale may be beneficial when the stimulation device (e.g., a deflagrating stimulation device) is employed in a drill string with other stimulation devices employing high explosives such that the ignition and/or initial release of energy from the deflagrating stimulation device using an energetic material such as a propellant occurs substantially simultaneously as the detonation of the high explosive stimulation devices (e.g., immediately following the fracturing initially caused by the high explosives). In such a configuration, the formation proximate the borehole may be fractured a selected distance with one or more high explosive stimulation devices immediately followed (e.g., within microseconds) by additional opening of the fractures by one or more deflagrating stimulation devices.

Further, the stimulation device employing an initiator device such as a shaped charge may enable a relatively more reliable and effective ignition of the energetic material within the stimulation device as compared to conventional stimulation devices. For example, the projectile or jet formed by the shaped charge may enable enhanced ignition of the energetic material through one or both of frictional heating and through pressurization of the housing caused by initiation of the shaped charge. Such enhanced ignition may enable pressure to build relatively faster in the housing. Further, in embodiments where pressure within the housing deforms the housing to form an aperture therein (e.g., when the housing lacks initial, preformed apertures) the housing may allow greater pressure to build therein as compared to conventional stimulation devices including initial, preformed apertures. Such building pressure may further enhance ignition and increase the rate of burn of the energetic material as the pressure increases within the initially sealed housing.

Finally, a stimulation device employing a removable shaped charge enables the entire initiator device to be separated from the energetic material in the housing providing an explosive safe and arm (S&A) feature enabling safe handling and/or transportation of the stimulation device and facilitating compliance with government regulations relating to such transport, particularly air transport to offshore well sites.

While particular embodiments of the disclosure have been shown and described, numerous variations and alternate embodiments encompassed by the present disclosure will occur to those skilled in the art. Accordingly, the disclosure is only limited in scope by the appended claims and their legal equivalents.

The invention claimed is:

1. A downhole stimulation device, comprising: a rigid housing having a first end, a second end, and a longitudinal axis extending between the first end and the second end; an energetic material disposed within the housing and completely enclosed by the stimulation device; and an initiator positioned exterior to the housing and removably coupled to one of the first end and the second end of the housing, the initiator comprising a shaped charge for igniting the energetic material within the housing, wherein the shaped charge is configured to produce a projectile to penetrate the energetic material to ignite the energetic material along a majority of the housing from the first end to the second end of the housing, and wherein a majority of the energetic material is positioned in the housing radially outward from the initiator in order to produce a radial burn in the energetic material extending outward toward the housing after the energetic material has been ignited by the projectile, wherein the housing is adapted to deform under internal pressure in the housing caused by gases produced by combustion of the energetic material to form at least one aperture in the housing in order to expel the gases produced by the combustion of the energetic material.

2. The downhole stimulation device of claim 1, wherein the energetic material entirely fills a cross-sectional area within the housing taken in a direction transverse to the longitudinal axis proximate to the initiator.

3. The downhole stimulation device of claim 1, wherein the energetic material comprises a channel in the energetic material extending along a majority of the longitudinal axis of the housing, the channel having a width taken in a direction perpendicular to the longitudinal axis of the housing that is less than a width of at least one of a case and a liner of the shaped charge taken in the direction perpendicular to the longitudinal axis of the housing.

4. The downhole stimulation device of claim 1, wherein the energetic material comprises a propellant grain.

5. The downhole stimulation device of claim 1, wherein the initiator is positioned to form a channel through the energetic material with the projectile formed by ignition of the shaped charge.

6. The downhole stimulation device of claim 1, wherein the shaped charge is positioned to penetrate the energetic material with the projectile along an entirety of the longitudinal axis of the housing from the first end to the second end of the housing.

7. The downhole stimulation device of claim 1, wherein the shaped charge is positioned to penetrate the energetic material with the projectile along a centerline of the housing.

8. The downhole stimulation device of claim 1, wherein a lateral outer surface of the housing extending in a direction transverse to the longitudinal axis of the housing comprises a continuous surface without any openings in the lateral outer surface.

9. The downhole stimulation device of claim 8, wherein the housing is adapted to deform under internal pressure in the housing caused by gases produced by combustion of the energetic material to form at least one aperture in the housing in order to expel the gases produced by the combustion of the energetic material.

10. The downhole stimulation device of claim 1, wherein the initiator comprises a plurality of shaped charges, each shaped charge of the plurality of shaped charges being coupled to one of the first end of the housing and the second end of the housing.

11. The downhole stimulation device of claim 1, wherein the shaped charge is positioned at the first end of the housing along a centerline of the housing and further comprising a second shaped charge positioned at the second end of the housing opposing the first end along the centerline of the housing.

12. The downhole stimulation device of claim 1, wherein the shaped charge is positioned at least partially within a cavity in the energetic material.

13. The downhole stimulation device of claim 12, wherein the cavity is coextensive with a centerline of the housing.

14. The downhole stimulation device of claim 12, wherein the cavity extends only through a minor portion of the energetic material in the housing along the longitudinal axis of the housing.

15. The downhole stimulation device of claim 1, wherein the shaped charge is removably coupled to the housing with a mechanical connection between the shaped charge and the housing, the mechanical connection between the shaped charge and the housing configured to enable removal of the shaped charge without damaging the device.

16. The downhole stimulation device of claim 1, wherein the stimulation device comprises a reinforcing element proximate the second end of the housing, the reinforcing element configured to increase a probability that the projectile from the shaped charge will penetrate the energetic material from the first end of the housing to the second end of the housing opposing the first end without penetrating through the second end of the housing and exiting the housing.

17. The downhole stimulation device of claim 1, wherein the shaped charge is adapted to produce the projectile that will penetrate the energetic material from the first end of the housing to the second end of the housing opposing the first end without penetrating through the second end of the housing and exiting the housing.

18. A downhole stimulation device, comprising:

a rigid cylindrical housing having a first end, a second end, and a longitudinal axis extending between the first end and the second end;

an energetic material disposed within the cylindrical housing and completely enclosed by the stimulation device, wherein a lateral outer surface of the cylindrical housing extending a direction transverse to the longitudinal axis of the housing and surrounding the energetic material comprises a continuous surface without any openings in the lateral outer surface; and an initiator positioned at least partially exterior to the cylindrical housing and removably coupled to one of the first end and the second end, the initiator comprising a shaped charge for igniting the energetic material within the cylindrical housing, wherein the housing is adapted to deform under internal pressure in the housing caused by gases produced by combustion of the energetic material to form at least one aperture in the housing in order to expel the gases produced by the combustion of the energetic material.

19. The downhole stimulation device of claim 18, wherein the initiator comprises a shaped charge configured to produce a projectile to penetrate the energetic material to ignite the energetic material along a majority of the cylindrical housing from the first end to the second end of the cylindrical housing.

20. The downhole stimulation device of claim 18, wherein the energetic material entirely fills at least a majority of an inner portion of the cylindrical housing coincident with and surrounding a centerline of the cylindrical housing.

21. The downhole stimulation device of claim 18, wherein an entirety of the lateral outer surface of the housing does not comprise any openings therein.

22. A downhole stimulation device, comprising:

a cylindrical housing having a first end, a second end, a longitudinal axis extending between the first end and the second end, and an imperforate lateral outer surface defined by a rigid portion of the cylindrical housing; an energetic material disposed within the cylindrical housing; and an initiator positioned exterior to the cylindrical housing and removably coupled to one of the first end of the housing and the second end of the housing, the initiator for igniting the energetic material within the cylindrical housing, wherein the energetic material is entirely enclosed by the stimulation device and the initiator, and wherein the imperforate lateral outer surface of the housing is adapted to deform under internal pressure in the housing caused by gases produced by combustion of the energetic material in the cylindrical housing to form at least one aperture in the cylindrical housing to permit expulsion from the cylindrical housing of the gases produced by the combustion of the energetic material.

23. The downhole stimulation device of claim 22, wherein the initiator is positioned to form a jet of particles through the energetic material in order to ignite the energetic material along a channel to initiate a substantially radial burn of the energetic material.

24. A method of operating a downhole stimulation device, the method comprising:

removably coupling a shaped charge at an exterior surface of a longitudinal end of a rigid housing of the stimulation device, the stimulation device having an energetic material disposed within and completely enclosed by the stimulation device, wherein the shaped charge is coupled to the housing at a surface of a borehole in which the stimulation device is to be deployed:

disposing the stimulation device in the borehole, wherein at least a portion of the energetic material within the housing is positioned laterally outward from the shaped charge;

initiating the energetic material with a jet formed with the shaped charge by penetrating the energetic material with the jet to ignite the energetic material along a depth of the borehole; and burning the energetic material in a laterally extending direction transverse to the depth of the borehole thereby producing combustion gases which rupture the housing.

25. A method of operating a downhole stimulation device, the method comprising:

removably coupling a removable shaped charge to an exterior portion of a longitudinal end of a rigid housing of the stimulation device having an energetic material disposed within the housing and completely enclosed by the stimulation device: initiating the energetic material disposed within the housing of the stimulation device; burning the energetic material in a laterally extending direction transverse to a depth of a borehole in which the stimulation device is disposed; forming at least one aperture in the housing with internal pressure in the housing caused by gases produced by combustion of the energetic material; and producing at least one gas stream extending laterally from the housing formed by the gases produced by combustion of the energetic material, wherein initiating an energetic material comprises: forming a jet with a shaped charge; and penetrating the energetic material with the jet to ignite the energetic material.

26. The method of claim 25, wherein forming at least one aperture in the housing comprises forming a plurality of apertures in the housing extending along a longitudinal axis of the housing to produce a plurality of gas streams extending laterally from the housing formed by the gases produced by combustion of the energetic material.

27. The method of claim 25, wherein initiating an energetic material comprises:

forming a jet with a shaped charge; and penetrating the energetic material with the jet to ignite the energetic material.

* * * * *